US010640311B2

(12) United States Patent
Kinoshita

(10) Patent No.: US 10,640,311 B2
(45) Date of Patent: May 5, 2020

(54) TRANSPORT APPARATUS, RECORDING APPARATUS, AND TRANSPORT METHOD

(71) Applicant: SEIKO EPSON CORPORATION, Tokyo (JP)

(72) Inventor: Masaaki Kinoshita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 15/922,486

(22) Filed: Mar. 15, 2018

(65) Prior Publication Data

US 2018/0282085 A1 Oct. 4, 2018

(30) Foreign Application Priority Data

Mar. 29, 2017 (JP) ..... 2017-065585

(51) Int. Cl.

| | |
|---|---|
| ***B41J 11/00*** | (2006.01) |
| ***B65H 5/26*** | (2006.01) |
| ***B65H 5/36*** | (2006.01) |
| ***B65H 7/06*** | (2006.01) |
| ***B65H 9/00*** | (2006.01) |
| ***B65H 23/038*** | (2006.01) |

(Continued)

(52) U.S. Cl.

CPC ..... *B65H 3/06* (2013.01); *B41J 11/42* (2013.01); *B41J 19/18* (2013.01); *B65H 3/0661* (2013.01); *B65H 5/26* (2013.01); *B65H 5/36* (2013.01); *B65H 7/02* (2013.01); *B65H 9/006* (2013.01); *B65H 9/008* (2013.01); *B65H 9/14* (2013.01); *B65H 23/038* (2013.01); *B65H 2402/31* (2013.01); *B65H 2402/32* (2013.01); *B65H 2402/46* (2013.01); *B65H 2403/942* (2013.01); *B65H 2404/144* (2013.01); *B65H 2404/1522* (2013.01); *B65H 2405/332* (2013.01)

(58) Field of Classification Search

CPC .. B41J 11/00; B41J 11/42; B41J 19/18; B65H 3/06; B65H 3/066; B65H 5/00; B65H 5/26; B65H 7/00; B65H 7/02; B65H 7/06; B65H 9/00; B65H 9/006; B65H 9/008; B65H 9/14; B65H 23/00; B65H 2402/31; B65H 2402/32; B65H 2402/46; B65H 2403/942; B65H 2404/144; B65H 2404/1522; B65H 2405/332; G03G 15/00

See application file for complete search history.

(56) References Cited

U.S. PATENT DOCUMENTS 8,876,111 B1 * 11/2014 Lan ..... B65H 5/06 271/273
9,304,472 B2 * 4/2016 Ishikawa ..... G03G 15/1605

(Continued)

FOREIGN PATENT DOCUMENTS

JP 2001/097578 A 4/2001
JP 2003-145872 A 5/2003
JP 2014114100 A * 6/2014 ..... B65H 9/00

*Primary Examiner* — Nguyen Q. Ha

(74) *Attorney, Agent, or Firm* — Workman Nydegger

(57) ABSTRACT

A transport apparatus includes a feed unit as an example of a supply unit which supplies a medium in a transport direction, and a transport unit which transports the medium supplied from the feed unit. The transport unit includes a transport roller (a driving roller) which sends the medium, and a driven roller which nips the medium between the transport roller and the driven roller. The driven roller is movable in the transport direction relative to the transport roller.

10 Claims, 7 Drawing Sheets

(51) Int. Cl.

| | |
|---|---|
| ***G03G 15/00*** | (2006.01) |
| ***B65H 3/06*** | (2006.01) |
| ***B41J 19/18*** | (2006.01) |
| ***B65H 7/02*** | (2006.01) |
| ***B41J 11/42*** | (2006.01) |
| ***B65H 9/14*** | (2006.01) |

(56) References Cited

U.S. PATENT DOCUMENTS

| | | | | |
|---|---|---|---|---|
| 2003/0085513 | A1 | 5/2003 | Takahara et al. | |
| 2014/0091518 | A1* | 4/2014 | Nishii ..... | B65H 29/14<br>271/274 |

* cited by examiner

RD

| MEDIUM TYPE | | REGULAR PAPER | PHOTOGRAPHIC PAPER | MATT PAPER | | ... |
|---|---|---|---|---|---|---|
| TENSION (gf) | T1 | 1000 | 1000 | ... | | ... |
| | T2 | 1500 | 1250 | ... | | ... |
| SPEED (ips) | V1 | 2 | 2 | ... | | ... |
| | V2 | 3 | 3 | ... | | ... |
| DISTANCE (mm) | D1 | 300 | 200 | ... | | ... |
| | D2 | 300 | 200 | ... | | ... |
| NUMBER OF TIMES | A | 3 | 2 | ... | | ... |

TRANSPORT APPARATUS, RECORDING APPARATUS, AND TRANSPORT METHOD

BACKGROUND

1. Technical Field

The invention relates to a transport apparatus which transports a medium, such as a paper sheet or a film, on which recording (like printing) is to be performed, a recording apparatus provided with a transport apparatus, and a transport method.

2. Related Art

A recording apparatus provided with a transport apparatus which feeds (supplies) and transports a medium, such as a paper sheet or a film, and a recording head (an example of a recording unit) which records (prints) text or an image on a transported medium using ink has been proposed.

In this kind of recording apparatus, the medium may be skewed (inclined) with respect to a transport direction while being fed by the transport apparatus. If recording is performed on the skewed medium, an image or the like is recorded in an inclined manner on the medium. Therefore, for example, in the printer described in JP-A-2003-145872, skew is corrected while a printing paper is fed onto a platen.

The printer includes a paper feed roller and a driven roller which feed the printing paper. For example, skew correction of the printing paper is performed in the following manner: after the printing paper hits the paper feed roller and the driven roller which feed the printing paper, the printing paper is nipped between these rollers (biting), the printing paper nipped between the paper feed roller and the driven roller is fed in the opposite direction and pressed back (discharging). Biting and discharging are repeated several times so that an upper end of the printing paper becomes parallel to the paper feed roller and the driven roller, whereby skew of the printing paper is corrected.

As another example, a recording apparatus provided with a transport apparatus which unrolls an elongated medium from a roll body, such as a rolled sheet, round which an unrecorded medium is wound in a rolled form, and supplies the unrolled medium to a recording unit has been proposed.

In a related art printer, if a medium of a rolled form, such as a rolled sheet, is employed as a printing paper, an end of the medium unrolled from the rolled form may be curled. Therefore, a user puts the end of the medium unrolled from the rolled form between rollers of a transport roller pair when setting the medium. Therefore, as in the printer described in JP-A-2003-145872, if the upper end of the printing paper is discharged from the paper feed roller and the driven roller, it is possible that the printing paper hits the paper feed roller and the driven roller and is not nipped by these rollers when the user tries to make the printing paper to be bitten by these rollers. For this reason, especially when a medium of a rolled form is to be fed in a recording apparatus, it is necessary to correct skew with the medium being nipped between rollers of a transport roller pair.

Further, some recording apparatuses which feed a medium of a rolled form include a mechanism with which a driven roller is movable in a direction to separate from a transport roller. When skew correction is performed, the driven roller is separated from the transport roller so that a medium is not nipped or slightly nipped by rollers of a transport roller pair, and the medium is alternately transported downstream and upstream in the transport direction while tension is applied to the medium. In this manner, skew of the medium is corrected.

However, in the printer described in JP-A-2003-145872, since the driven roller is not able to be positively separated from the paper feed roller, the printing paper is nipped by the paper feed roller and the driven roller relatively strongly while being fed. Therefore, sliding is not easily caused between the printing paper, the paper feed roller, and the driven roller. Therefore, there is an issue that effectively correcting skew is difficult. This is a substantially common issue in cases in which skew of a medium is to be corrected more effectively (not only rolled sheets but also cut sheets).

SUMMARY

An advantage of some aspects of the invention is to provide a transport apparatus, a recording apparatus, and a transport method capable of effectively correcting skew of a medium.

Hereinafter, means, operations and effects for solving the above problem will be described. According to an aspect of the invention, a transport apparatus includes a supply unit that supplies a medium in a transport direction, a transport unit that transports the medium supplied from the supply portion, the transport unit includes a transport roller that sends the medium, and a driven roller that nips the medium between the transport roller and the driven roller, and the roller is movable in the transport direction relative to the transport roller.

With this configuration, slidability between the medium and the transport roller can be adjusted by changing a relative position of the driven roller with respect to the transport roller in the transport direction. Therefore, skew of the medium can be corrected effectively.

In the transport apparatus, it is desirable that the driven roller is provided to be movable in the transport direction, and the transport apparatus further includes an urging member that urges the driven roller toward the transport direction. With this configuration, when the transport roller is rotated in a rotational direction in which the medium can be transported in the urging direction of the urging member, the driven roller can be moved in the transport direction positively with the urging force of the urging member. Therefore, the driven roller can be moved in the transport direction more stably and in a greater moving amount. For example, an occurrence frequency of a failure in skew correction resulting from a failure in movement that the driven roller does not move in the transport direction as desired can be reduced. Therefore, a frequency of performance of appropriate skew correction can be increased.

In the transport apparatus, when the transport roller sends the medium downstream in the transport direction, an axial center of the driven roller is located downstream of an axial center of the transport roller in the transport direction.

With this configuration, when the transport roller sends the medium downstream in the transport direction, the axial center of the driven roller is located downstream of the axial center of the transport roller in the transport direction, and the contact area of the medium and the transport roller can be increased relatively. Therefore, accuracy in transport position of the medium by the transport roller and the driven roller can be increased.

In the above transport apparatus, an amount of misalignment in the transport direction of an axial center of the driven roller and an axial center of the transport roller when the transport roller sends the medium upstream in the transport direction is smaller than the amount of misalignment when the transport roller sends the medium upstream in the transport direction.

With this configuration, sliding resistance between the medium and the transport roller when the transport roller sends the medium upstream in the transport direction becomes relatively smaller than sliding resistance between the medium and the transport roller when the medium is sent downstream in the transport direction. Therefore, the medium becomes relatively slidable with respect to the transport roller, and skew of the medium can be corrected effectively. When the transport roller sends the medium downstream in the transport direction, the medium does not easily slide relative to the transport roller. Therefore, after the skew correction is completed, accuracy in transport position when sending the medium downstream in the transport direction can be increased.

According to another aspect of the invention, a recording apparatus a recording apparatus that records on a medium, which includes the transport apparatus described above, a recording unit that records on the medium supplied by the transport apparatus. With this configuration, Therefore, the recording unit can record on the medium supplied by the transport apparatus in the state in which skew has been corrected. Therefore, a printed matter of high quality in which inclination, misalignment and the like of the medium are reduced can be provided.

According to a further aspect of the invention, a transport method in a transport apparatus provided with a transport unit that includes a supply unit that supplies a medium in a transport direction, a transport roller that sends the medium supplied from the supply unit, and a driven roller that nips the medium between the transport roller and the driven roller, the method including: forward-transporting the medium downstream in the transport direction in a state in which an axial center of the driven roller in the transport direction is located downstream of an axial center of the transport roller in the transport direction; and reverse-transporting the medium upstream in the transport direction in the state in which an amount of misalignment of the axial center of the driven roller and an axial center of the transport roller in the transport direction is made smaller than the amount of misalignment in the forward transporting, wherein the forward transport process and the reverse transport process are repeated a plurality of times.

With this method, in the reverse transport process, sliding resistance between the medium and the transport roller can be made smaller than in the forward transport process, and the medium can be made easy to slide with respect to the transport roller. Since the forward transport process and the reverse transport process are repeated a plurality of times, skew of the medium can be corrected effectively.

In the above transport method, at least one of a tension to be applied to the medium and a speed at which the medium is to be transported is made larger in the reverse transport process than in the forward transport process. With this method, In the reverse transport process in which sliding resistance between the medium and the transport roller can be made relatively small, at least one of the tension to be applied to the medium and the speed at which the medium is to be transported is made larger than in the forward transport process. Therefore, compared with a case in which the value of the tension and the value of the speed are made to be the same in the forward transport process and in the reverse transport process, for example, the skew correction effect can be more effectively improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus provided with a transport apparatus according to an embodiment will be described with reference to the drawings. The recording apparatus of the present embodiment is a printer 11 illustrated in FIG. 1 which includes a transport apparatus which transports a medium and records (such as prints) on the medium transported by the transport apparatus.

Figure 1:
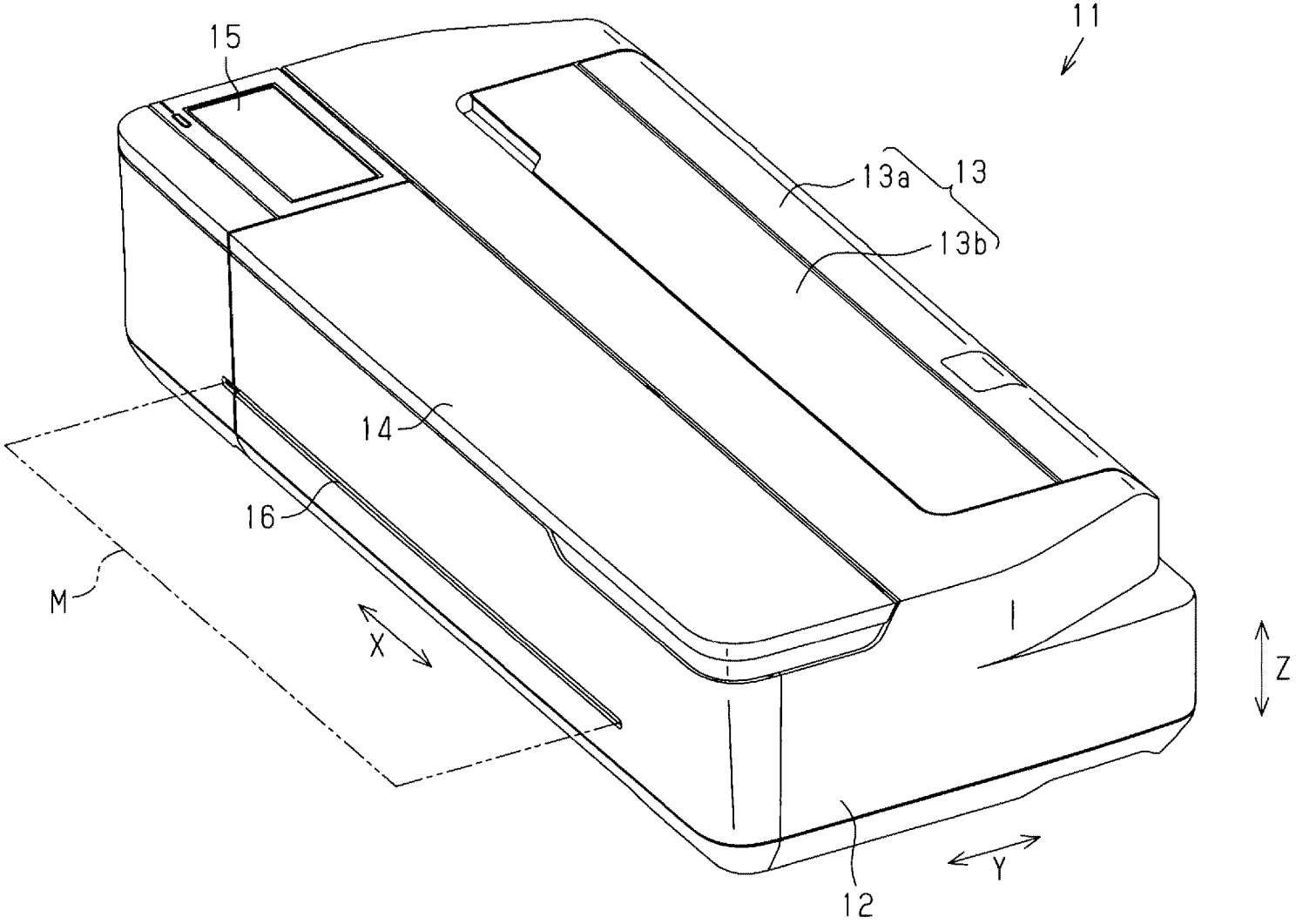
FIG. 1 is a perspective view of a printer according to an embodiment.

In the following description, suppose that the printer 11 illustrated in FIG. 1 is placed on a horizontal plane, a vertical direction is defined as a direction Z, a direction along a horizontal plane which (orthogonally) crosses the vertical direction Z is defined as a direction X, and a transport direction is defined as a direction Y. That is, the width direction X, the transport direction Y, and the vertical direction Z are different from one another, and (desirably orthogonally) cross one another. In the transport direction Y, a downstream side on which a medium M is transported during printing may be referred to as a front side, and an opposite side thereof may be referred to as a back side.

As illustrated in FIG. 1, the printer 11 which is an example of a recording apparatus has a supply/transport function to supply (feed) and transport the medium M, such as a paper sheet, and a recording function to record (print) an image including text, figures, and so forth on the transported medium M. The printer 11 includes a substantially rectangular parallelepiped housing 12. A feeding cover 13 located on the back side (an upstream end in the transport direction Y) is provided on an upper surface of the housing 12 to be movable between an open position and a closed position. Inside of the housing 12 is exposed in the open position and not exposed in the closed position. The feeding cover 13 includes a first cover 13*a* attached to the housing 12 to be rotatable around a shaft 13*c* (see FIG. 3), and a second cover 13*b* connected to a rotating end of the first cover 13*a* to be rotatable via an unillustrated hinge. When the feeding cover 13 is opened, a user can set the medium M in the exposed housing 12. In the printer 11 of the present embodiment, a rolled sheet and a cut sheet can be set as a medium.

A maintenance cover 14 is provided on the upper surface of the housing 12 on the front side (a downstream side in the transport direction Y). An operation panel 15 on which the user performs various operations of the printer 11 is provided adjacent to the maintenance cover 14 in the width direction X on the upper surface of the housing 12. The operation panel 15 is a touch panel, for example, and on which information can be displayed and input. The operation panel 15 is provided to be rotatable around an unillustrated rotating shaft provided on a front side, and is capable of changing its position between an erect position and a tilted position. An outlet 16 through which the printed medium M is discharged is provided on a front surface of the printer 11. In the printer 11, the medium M set by the user who opened the feeding cover 13 is transported downstream (on the left side in FIG. 1) in the transport direction Y, printing is performed on the medium M while the medium M is transported, and the printed medium M is discharged from the outlet 16.

Figure 2:
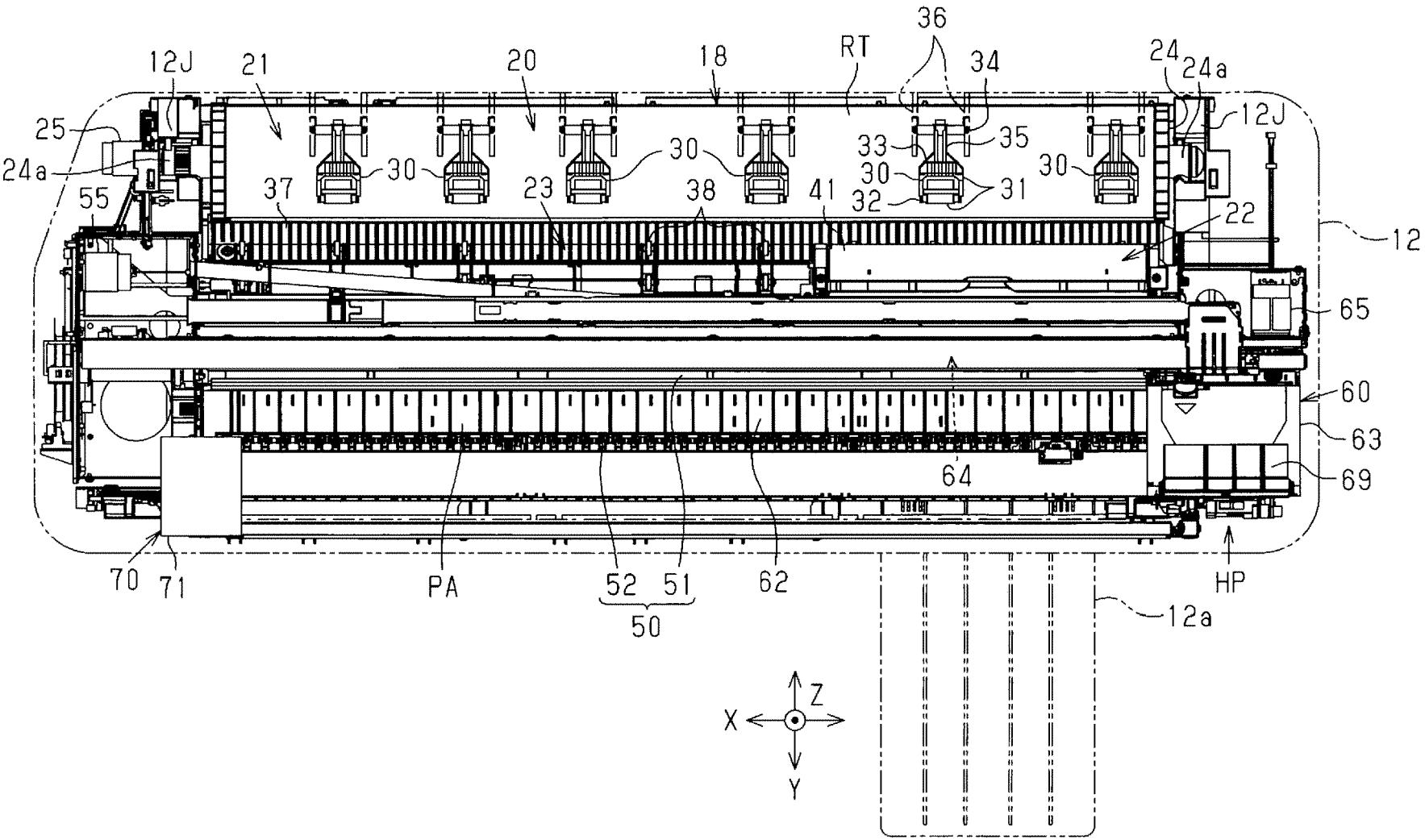
FIG. 2 is a plan view illustrating an internal structure of a printer.
Figure 3:
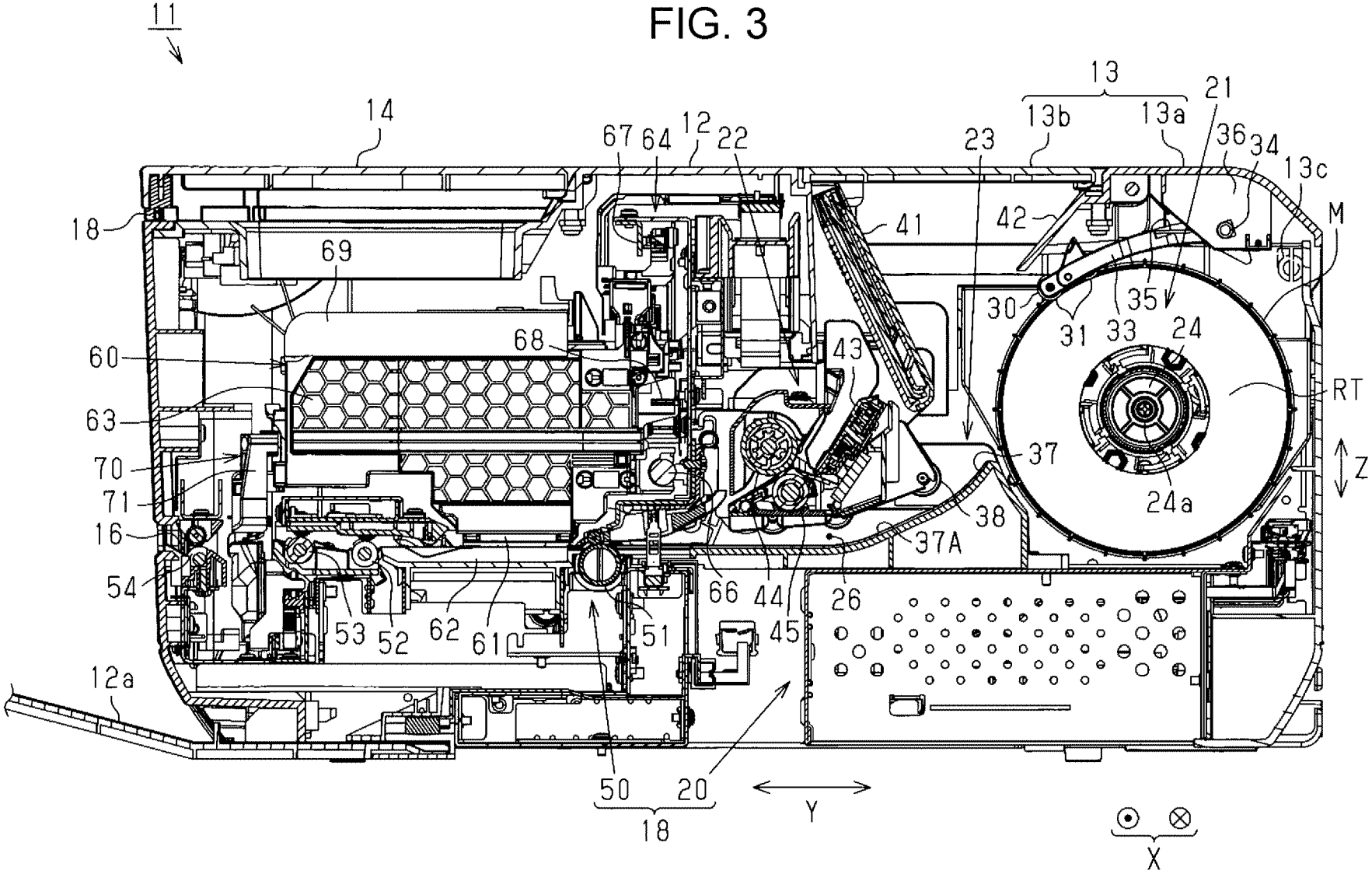
FIG. 3 is a sectional side view illustrating an internal structure of a printer.

As illustrated in FIGS. 2 and 3, the printer 11 includes a transport apparatus 18 which transports the medium M, and a recording unit 60 which records (prints) at least one of text and an image (hereinafter, referred to as an image and the like) on the medium M transported by the transport apparatus 18. The transport apparatus 18 includes a feed unit 20 as an example of a supply unit which supplies (feeds) the medium M, and a transport unit 50 which transports the medium M fed from the feed unit 20. The recording unit 60 records an image and the like on the medium M transported by the transport unit 50.

As illustrated in FIGS. 2 and 3, the printer 11 includes, as a feed unit 20, a first feed unit 21 which unrolls the elongated medium M from a roll body RT and feeds, and a second feed unit 22 and a third feed unit 23 which feed the media M which are cut sheets of different sizes. The first feed unit 21 holds the roll body RT (for example, a rolled sheet) round which an unrecorded medium M is wound in a rolled form to be rotatable, and unrolls the elongated medium M from the roll body RT and feeds downstream in the transport direction Y. The first feed unit 21 can hold a plurality of types of roll bodies RT of different lengths (widths) in the width direction X and diameters. The first feed unit 21 can perform a feed operation to unroll the medium M by causing the roll body RT to rotate in a forward direction, and a winding operation (a pulling-back operation) to wind the medium M round the roll body RT by causing the roll body RT in a reverse direction and transporting the medium M upstream in the transport direction Y. The first feed unit 21 can hold a plurality of types of roll bodies RT having the width smaller than the largest width (the largest width here is a predetermined width within a range of 20 to 40 inches) (for example, 36 inches).

The second feed unit 22 has a function to feed a first cut sheet which is a cut sheet of relatively smaller sizes (for example, an A3 size or an A4 size). The third feed unit 23 has a function to feed a second cut sheet of a larger size than the first cut sheet (for example, 24 inches or 36 inches). In the present embodiment, the first feed unit 21, the second feed unit 22, and the third feed unit 23 function as the supply units which supply media M of different types or sizes to the recording unit 60.

The first feed unit 21 includes a feed axis 24 which holds the cylindrical roll body RT to be rotatable, and a feed motor 25 which outputs power that makes the feed axis 24 rotate. The elongated medium M is unrolled from the roll body RT when the feed axis 24 is rotated in one way (counterclockwise in FIG. 3) by the power of the feed motor 25. As illustrated in FIG. 2, the first feed unit 21 includes bearing portions 12J in which shaft ends 24*a* on both sides of the feed axis 24 supporting the roll body RT can be inserted. The user causes the to-be-set roll body RT to be held by the feed axis 24, opens the feeding cover 13 and sets the roll body RT in a predetermined placement position illustrated in FIGS. 2 and 3 in the housing 12. During setting of the roll body RT, a pair of shaft ends 24*a* is inserted in a pair of bearing portions 12J, whereby the feed axis 24 is connected so that power can be transmitted to the feed motor 25.

As illustrated in FIGS. 2 and 3, the transport unit 50 includes a transport roller pair 51 disposed upstream of the recording unit 60 in the transport direction Y in a transport path of the medium M, and discharge roller pairs 52 to 54 disposed downstream of the recording unit 60 in the transport direction Y. The transport roller pair 51 rotates while nipping the medium M, and transports the medium M in the direction according to a rotational direction of the transport roller pair 51 at that time. The transport roller pair 51 is used to send the medium M during printing downstream in the transport direction Y, and to perform later-described skew correction in order to correct skew (skew feeding) of the medium M during feeding.

The discharge roller pairs 52 to 54 illustrated in FIGS. 2 and 3 rotate while nipping the medium M and discharge the printed medium M downstream in the transport direction Y. In the example illustrated in FIG. 3, a plurality of (for example, three) discharge roller pairs 52 to 54 is arranged along the transport direction Y, and the printed medium M is discharged downstream in the transport direction Y while being nipped by a plurality of discharge pair of rollers 52 to 54 in a plurality of positions.

The second feed unit 22 is constituted by an automatic sheet feeder including an elastic feed tray 41 on which a plurality of media M is stackable. The second feed unit 22 sequentially feeds the cut sheets set in the feed tray 41 one at a time from the topmost sheet.

The third feed unit 23 includes a manual feed tray 42 illustrated in FIG. 3 on the back side of the second cover 13*b*. The user can manually set a large-sized second cut sheet of which largest width is substantially the same as the width of the roll body RT of the largest width that can be set in the printer 11. The elongated medium M unrolled from the roll body RT by the first feed unit 21 and the second cut sheet manually inserted in the third feed unit 23 are fed to the transport unit 50 through a common transport path.

As illustrated in FIGS. 2 and 3, the first feed unit 21 includes a plurality of pressing portions 30 which press an outer peripheral surface of the set roll body RT at a plurality of positions at predetermined intervals in the width direction X with the feeding cover 13 being closed. Each of the pressing portions 30 presses the outer peripheral surface of the roll body RT (the medium M of the outermost periphery) in a position downstream of the axial center of the feed axis 24 of the roll body RT in the transport direction Y.

As illustrated in FIGS. 2 and 3, each of the pressing portions 30 is held at an end portion of a lever 33 attached to a pair of rib-shaped walls 36 (see FIG. 2) extending from a back surface of the first cover 13*a* (see FIG. 3) to be swingable around a shaft 34. Each of the pressing portions 30 has cylindrical rollers 31 rotatably held in a holding portion 32 connected to the end portion of the lever 33. The lever 33 is urged by a twisted coil spring 35 wound round the shaft 34 in a direction in which the pressing portions 30 can press the outer peripheral surface of the roll body RT (counterclockwise in FIG. 3). In this example, every two rollers 31 are held in two different positions in a circumferential direction with respect to the outer peripheral surface of the roll body RT to be in contact with each of the pressing portions 30.

In a state in which the feeding cover 13 is moved to the open position, the lever 33 is separated from the roll body RT and the press against the roll body RT of the pressing portions 30 is released. In a state in which the feeding cover 13 is moved to the closed position, the lever 33 is moved close to the roll body RT and the pressing portions 30 press the outer peripheral surface of the roll body RT with the urging force of the twisted coil spring 35. A rotation radius of the lever 33 is set to be longer than a radius of the roll body RT of the largest diameter usable in the printer 11. Therefore, while the diameter of the roll body RT changes from the largest to the smallest, the pressing portions 30 always press the outer peripheral surface of the roll body RT in the positions shifted from the center of the roll body RT to the downstream in the transport direction Y.

As illustrated in FIG. 2, a plurality of pressing portions 30 differs in the intervals (pitches) between the centers of adjacent pressing portion 30 depending on the position in the width direction X of the roll body RT. Therefore, even if a roll body RT of any width is set, the pressing portions 30 can press the outer peripheral surface of the roll body RT at a plurality of positions at appropriate intervals in the width direction X. For example, a 24-inch wide roll body RT is pressed by the four right-side pressing portions 30 in the width direction X, and a 36-inch wide roll body RT is pressed by all the six pressing portions 30 in the width direction X.

As illustrated in FIG. 3, the second feed unit 22 is an automatic sheet feeder which includes the feed tray 41, a hopper 43, a feed roller (a pickup roller) 44, and a retard roller 45. The feed tray 41 is stretchable to be drawable from the housing 12 in the opened state of the second cover 13*b* and is rotatable to incline backward. The hopper 43 presses the first cut sheets on the feed tray 41 against the feed roller 44 by moving the stacked first cut sheets set on the feed tray 41 to an operating position from a retracted position separated from the feed roller 44. The feed roller 44 rotates with the hopper 43 being in the operating position, whereby the first cut sheet is sequentially fed one at a time from the plurality of the first cut sheets between the feed roller 44 and the retard roller 45 from the topmost sheet on the feed tray 41 to the downstream in the transport direction Y. A placing board 12*a* (a stacker) on which the first cut sheet to be fed from the feed tray 41 and discharged from the outlet 16 after printing can be placed is attached to the housing 12 as needed (see FIGS. 2 and 3). Since the feed tray 41 is located at a forwardly inclined position as illustrated in FIGS. 2 and 3, the second cut sheet can be set (inserted) in the third feed unit 23.

As illustrated in FIGS. 2 and 3, the third feed unit 23 is located between the first feed unit 21 and the second feed unit 22, and has a function to feed the second cut sheet set by the user in the manual feed tray 42. In a state in which only the second cover 13*b* of the feeding cover 13 is in the open position, the manual feed tray 42 is located at a backwardly inclined angle, and the manual feed tray 42 guides the second cut sheet in a slanted position. The manual feed tray 42 includes an edge guide (not illustrated) which guides both side ends of the second cut sheet, and the second cut sheet is positioned by the edge guide in the width direction X. As illustrated in FIGS. 2 and 3, a guide 37 which guides the elongated medium M and the second cut sheet is provided downstream of the roll body RT held by the first feed unit 21 in the feed path in the housing 12 and below the second feed unit 22 in the vertical direction Z. When the user inserts the second cut sheet along the manual feed tray 42, the second cut sheet can be inserted along the manual guide 37 to a position in which the leading end of the second cut sheet reaches the transport roller pair 51.

The elongated medium M unrolled from the roll body RT by the first feed unit 21 and the second cut sheet manually set to the third feed unit 23 are fed along the common feed path 26. The feed path 26 is formed by a guide surface 37A of the guide 37 which guides the back surface of the medium M, and a plurality of guide rollers 38 disposed along the guide surface 37A so as to regulate a lift of the medium M from the guide surface 37A to a predetermined range.

As illustrated in FIG. 3, the common feed path of the elongated medium M from the first feed unit 21 and the second cut sheet fed from the third feed unit 23, and the feed path of the second cut sheet fed from the second feed unit 22 merge in a position upstream of the transport unit 50. The transport roller pair 51 is located on an extension line in the feeding direction of the second feed unit 22. The transport roller pair 51 is located on an extension line in the feeding direction of the medium M fed from the first feed unit 21 and the third feed unit 23, and is fed horizontally along the guide surface 37A in the transport direction Y. Therefore, the medium M (the elongated medium and the cut sheet) fed from each of the feed units 21 to 23 is supplied to the transport roller pair 51 disposed at the uppermost stream in the transport unit 50 in the transport direction Y in common, and is nipped by the rollers of the transport roller pair 51.

As illustrated in FIGS. 2 and 3, the transport unit 50 includes the transport roller pair 51 which transports the medium M fed from the feed unit 20 toward a print region PA (see FIG. 2) in which the recording unit 60 can print, and the discharge roller pairs 52 to 54 (see FIG. 3) which discharge the medium M on which the recording unit 60 printed. Each driving roller which constitutes each pair of rollers 51 to 54 is connected to a transport motor 55 disposed in a position outside of a transport area of the medium M in the width direction X via an unillustrated gear mechanism so that power can be transmitted. As illustrated in FIG. 3, the feed axis 24, the feed roller 44, and each pair of rollers 51 to 54 are disposed to be rotatable so that each axial direction thereof coincides with the width direction X, and can transport the medium M in the transport direction Y by rotation, respectively. In the present embodiment, the feed roller 44 which constitutes the second feed unit 22 is connected to the transport motor 55 via an unillustrated gear mechanism so that power can be transmitted to the transport motor 55. Therefore, the power source is shared by the feed roller 44, the transport roller pair 51, and the like.

As illustrated in FIGS. 2 and 3, the recording unit 60 includes a recording head 61 which records on the medium M, and a support base 62 which supports the medium M transported by the transport unit 50 in a position in which the medium M can face the recording head 61. The support base 62 is located between the transport roller pair 51 and the discharge roller pair 52 in the transport direction Y. The recording head 61 records (prints) an image and the like on the medium M at a portion on the support base 62. As illustrated in FIG. 2, the medium M on the support base 62 is supported by a plurality of ribs extending in the transport direction Y.

The recording unit 60 illustrated in FIGS. 2 and 3 employs, for example, a serial printing method and includes a carriage 63 which causes the recording head 61 to reciprocate in the width direction X (a scanning direction), a movement mechanism 64 which causes the carriage 63 to reciprocate in the width direction X, and a carriage motor 65 which outputs power for moving the carriage 63 to the movement mechanism 64. The movement mechanism 64 includes a guide shaft 66 and a guide portion 67 which guide the movement of the carriage 63, a pair of pulleys (not illustrated) positioned at both ends of a moving path of the carriage 63, and a timing belt 68 wound round a pair of pulleys. The guide shaft 66 and the guide portion 67 are provided to extend in the width direction X in the housing 12. One of the pulleys is connected to an output shaft of the carriage motor 65. The carriage 63 is fixed to a part of the timing belt 68, and reciprocates along the guide shaft 66 and the guide portion 67 in the width direction X by the forward and reverse driving of the carriage motor 65.

As illustrated in FIG. 2, at least one (for example, four) liquid receptacle 69 which accommodates a liquid (for example, ink) is removably attached to the carriage 63. The recording unit 60 ejects the liquid supplied from the liquid receptacle 69 from a plurality of nozzles (not illustrated) of the recording head 61 when the carriage 63 moves in the width direction X, and prints text and images on the medium M. The printer 11 includes an unillustrated maintenance device which can maintain and recover liquid ejection performance of the recording head 61. If the recording head 61 of a serial printing method is employed, a maintenance device is provided below the carriage 63 located in a home position HP which is a standby position when printing is not performed. A line printing method may be employed in the recording unit 60. The recording head 61 of a line printing method is a line head which has an elongate shape longer in the width direction X than the largest width of the medium M, and prints at a high speed on the medium M transported at a constant speed in the transport direction Y.

As illustrated in FIG. 2, in the housing 12, a cutter unit 70 is provided in the transport direction Y in a position near the upstream side of the outlet 16. The cutter unit 70 includes a carriage 71 which is movable in the width direction X and has a pair of rotary blades (not illustrated). When the carriage 71 moves in the width direction X, a pair of rotary blades rotates and the printed elongated medium M is cut at a predetermined length (for example, the length for 1 page).

In the present embodiment, control to avoid that the elongated medium M extended from the first feed unit 21 and exiting on the feed path 26 interferes with the medium M supplied from the second feed unit 22 and the third feed unit 23 is performed. If the elongated medium M unrolled from the roll body RT is supplied to the recording unit 60, the elongated medium M is rewound on the opposite side of the supply direction so that supply to the recording unit 60 of the first cut sheet or the second cut sheet is not interfered. When the printer 11 detects that the user opened at least the second cover 13*b* of the feeding cover 13, for example, the printer 11 determines that there is a possibility that the medium M is to be set and fed to the second feed unit 22 and the third feed unit 23, and performs the rewinding operation. With the rewinding operation, the leading end of the elongated medium M is retracted to a position in which the leading end of the elongated medium M does not interfere with the cut sheet fed by the second feed unit 22 and the third feed unit 23 (a standby position).

Next, a detailed configuration of the transport roller pair 51 will be described with reference to FIG. 4. The transport roller pair 51 includes a transport roller 56 supported to be rotatable in a position upstream in the transport direction Y of the support base 62 in the transport direction Y, and a driven roller 57 which is driven by the transport roller 56 to rotate with the medium M being nipped between the driven roller 57 and the transport roller 56. The transport roller 56 is a driving roller which is rotated by power of the transport motor 55 (see FIG. 2). The driven roller 57 is urged in a direction to approach to the transport roller 56, and the medium M is nipped between the transport roller 56 and the driven roller 57 by the pressure caused by urging of the driven roller 57.

Figure 4:
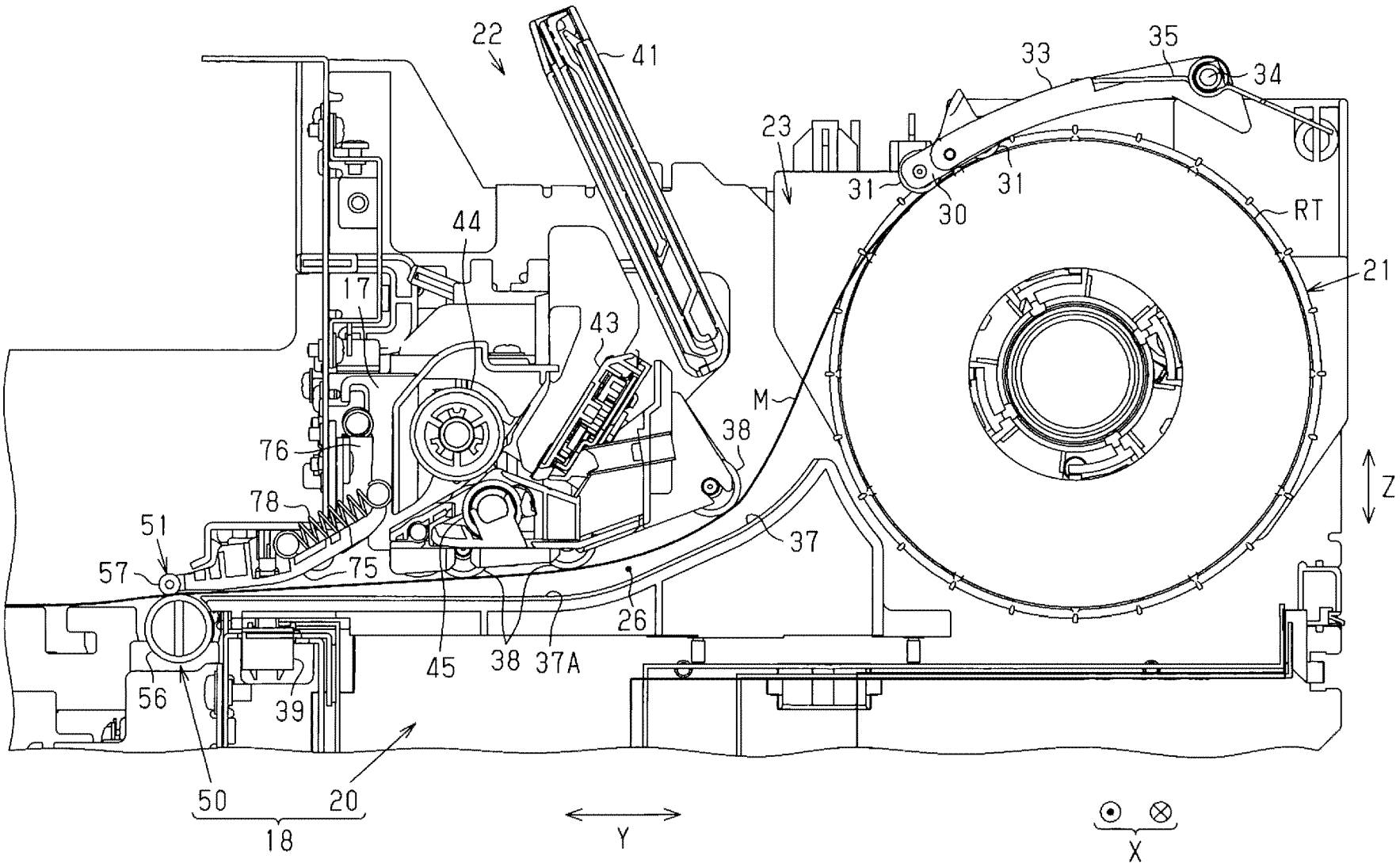
FIG. 4 is a partially enlarged sectional side view of an internal structure of a printer.

As illustrated in FIG. 4, in a position slightly upstream of the transport roller pair 51 in the transport direction Y, a swing member 75 is supported to be swingable in a predetermined angle range with respect to a frame 17 attached in the housing 12. The driven roller 57 is supported to be rotatable at an end portion of the swing member 75 on the downstream side in the transport direction Y. The swing member 75 is rotatable around a shaft 77 illustrated in FIG. 5 with respect to the frame 17. The shaft 77 is disposed so that an axis thereof is parallel to the width direction X. As illustrated in FIG. 4, the swing member 75 is urged to rotate counterclockwise in FIG. 4 around the shaft 77 by a tension spring 76. The swing member 75 is urged to press the driven roller 57 against the transport roller 56 by the tension spring 76. Therefore, the driven roller 57 nips the medium M between the driven roller 57 and the transport roller 56 with predetermined pressure. A lower surface of the swing member 75 is a guide surface which guides the first cut sheet fed from the second feed unit 22 to the nip position of the transport roller pair 51. As illustrated in FIG. 4, a sensor 39 which can detect the medium M fed from each of the feed units 21 to 23 is disposed upstream of the transport roller pair 51 in the transport direction Y. Although the sensor 39 is a noncontact sensor which is an optical sensor in the example illustrated in FIG. 4, a contact sensor may be employed.

The driven roller 57 of the present embodiment can move relative to the transport roller 56 in the transport direction Y. In particular, the swing member 75 is supported to be movable (slidable) with respect to the frame 17 in the transport direction Y. When the swing member 75 moves with respect to the frame 17 in the transport direction Y, the driven roller 57 supported at the end portion is movable in the transport direction Y with respect to the transport roller 56 supported to be rotatable at a predetermined position of the frame 17. As a mechanism which enables the swing member 75 to be movable with respect to the frame 17 here may be, for example, a sliding mechanism which makes the shaft 77 which becomes a rotation axis of the swing member 75 movable in the transport direction Y with respect to the frame 17, or a sliding mechanism which makes the swing member 75 movable in the transport direction Y with respect to the shaft 77 which becomes a rotation axis. In the former case, for example, the shaft 77 is inserted in an elongated hole formed in the frame 17, and the shaft 77 moves along the elongated hole, whereby the swing member 75 can be moved with respect to the frame 17 in the transport direction Y. In the latter case, for example, the shaft 77 supported by the frame 17 is inserted in an elongated hole formed in the swing member 75, whereby the swing member 75 can be moved with respect to the shaft 77 in the transport direction Y. That is, The driven roller 57 may desirable by movable in the transport direction Y with respect to the transport roller 56.

Figure 5:
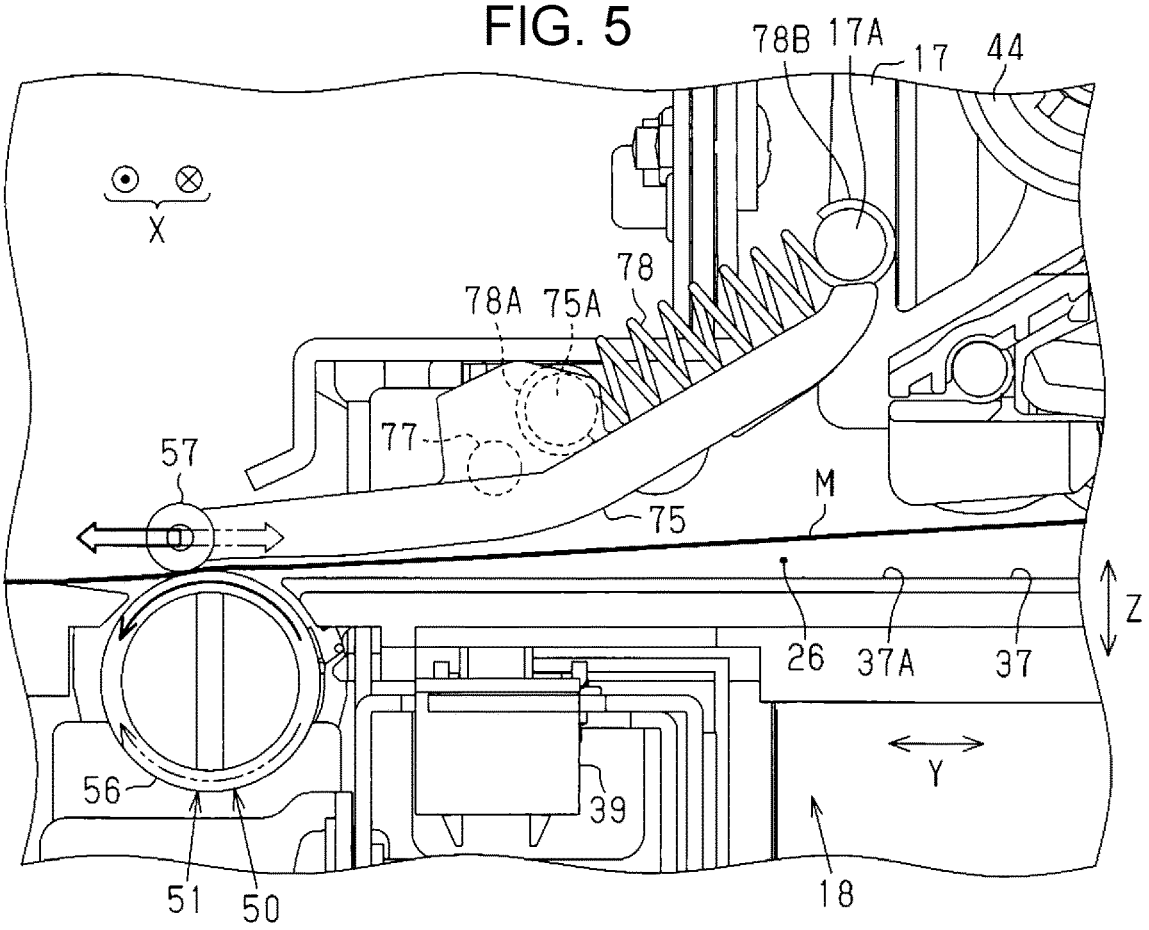
FIG. 5 is a side view of a main part illustrating skew correction.

As illustrated in FIG. 5, the transport apparatus 18 includes a tension spring 78 as an example of an urging member which urges the driven roller 57 which is movable in the transport direction Y with respect to the transport roller 56 in the transport direction Y. The swing member 75 is urged in the transport direction Y by the tension spring 78.

A first end portion 78A of the tension spring 78 in the longitudinal direction is latched by a pin portion 75A provided to project from the swing member 75, and a second end portion 78B located on the opposite side of the first end portion 78A in the longitudinal direction is latched by a pin portion 17A provided to project from the frame 17. In FIG. 5, the driven roller 57 is located in a position when the transport roller 56 rotates in a forward direction illustrated by an arrow depicted by a solid line in FIG. 5 (counterclockwise in FIG. 5) to send the medium M downstream in the transport direction Y. When the swing member 75 is located in a position in which the driven roller 57 is disposed in a position illustrated in FIG. 5, a distance when the pin portion 17A and the pin portion 75A approach each other the most is set to be longer than a natural length of the tension spring 78. The pin portion 17A of the frame 17 is located upstream of the pin portion 75A of the swing member 75 in the transport direction Y.

Therefore, the swing member 75 movable in the transport direction Y is urged to the upstream in the transport direction Y by the tension spring 78. Thus, the swing member 75 is urged in two different directions by the tension spring 76 (a first urging member) which urges the driven roller 57 against the transport roller 56 and the tension spring 78 (a second urging member as an urging member) which urges the driven roller 57 movable in the transport direction Y in one direction in the transport direction Y (for example, upstream). Each one of swing members 75 urged to press the driven roller 57 and upstream in the transport direction Y supports, at an end portion thereof, one or a plurality of (for example, three) driven rollers 57 arranged in the width direction X. A plurality of swing members 75 is supported by the frame 17 and arranged in the width direction X. Here, in the example illustrated in FIG. 5, the urging direction by the tension spring 78 is an oblique direction which crosses the transport direction Y at a predetermined acute angle (for example, a predetermined angle from 10° to 40°). Even if the urging direction is an oblique direction with respect to the transport direction Y, the urging direction may desirably contain an urging direction component in the transport direction Y. The number of swing members 75 and the number of driven rollers 57 supported by the swing member 75 can be changed.

The transport motor 55 (see FIG. 2) which is a driving source of the transport roller 56 is an electric motor which can be driven to rotate in the forward direction and the reverse direction. When the transport motor 55 is driven to rotate in the forward direction, the transport roller 56 is rotated counterclockwise in the forward direction illustrated in FIG. 5 in which the medium M can be transported downstream in the transport direction Y (forward transport) illustrated by the arrow depicted by the solid line in FIG. 5 (forward rotation). When the transport motor 55 is driven to rotate in the reverse direction, the transport roller 56 is rotated clockwise in the reverse direction illustrated in FIG. 5 in which the medium M can be transported upstream in the transport direction Y in the reverse direction illustrated by an arrow depicted by a two-dot chain line in FIG. 5 (reverse rotation).

Figure 6:
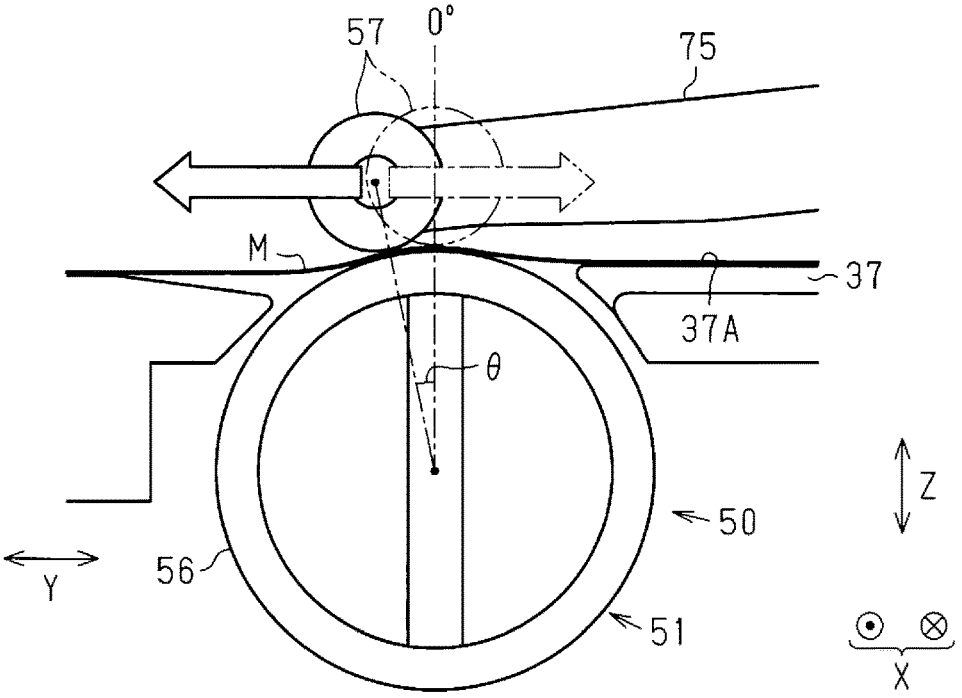
FIG. 6 is a side view illustrating a position displacement of a driven roller during skew correction.

When the transport roller 56 is rotated in the forward direction illustrated by the arrow depicted by the solid line in FIG. 5, the driven roller 57 receives force from the medium M in the direction downstream in the transport direction Y illustrated by a white arrow depicted by a solid line in FIG. 5, and is displaced downstream in the transport direction Y to a position depicted by a solid line in FIGS. 5 and 6 against the urging force of the tension spring 78 while rotating clockwise in the forward direction in FIG. 5. When the transport roller 56 is rotated in the reverse direction illustrated by the arrow depicted by the two-dot chain line in FIG. 5, the driven roller 57 receives force from the medium M in the direction upstream in the transport direction Y illustrated by a white arrow depicted by a two-dot chain line in FIG. 5, and is displaced upstream in the transport direction Y to a position depicted by the two-dot chain line in FIG. 6 by the urging force of the tension spring 78 while rotating counterclockwise in FIG. 5.

Here, as illustrated in FIG. 6, an angle made by a straight line connecting axial centers of the transport roller 56 and the driven roller 57 and a vertical line which passes through an axial center of the transport roller 56 is defined as a winding angle θ. During the forward transport process in which the transport roller 56 sends the medium M downstream in the transport direction Y, the axial center of the driven roller 57 which has been displaced downstream in the transport direction Y is located downstream of the axial center of the transport roller 56 in the transport direction Y. At this time, the winding angle θ becomes θ=θ1 (>0°). During the reverse transport process in which the transport roller 56 sends the medium M upstream in the transport direction Y, the axial center of the driven roller 57 which has been displaced upstream in the transport direction Y is disposed in a position in which an amount of misalignment of the axial center of the driven roller 57 and the axial center of the transport roller 56 in the transport direction Y becomes smaller than the amount of misalignment during the forward transport process. At this time, the winding angle θ becomes θ=θ2 (<θ1). Especially in this example, the winding angle θ=θ2 during the reverse transport process is set to be about 0°. That is, in the reverse transport process, the driven roller 57 moves in the transport direction Y to the position in which the axial center of the driven roller 57 substantially coincides with the axial center of the transport roller 56 in the transport direction Y.

As illustrated in FIG. 6, the medium M fed from the upstream in the transport direction Y enters substantially horizontally between the transport roller pair 51. The driven roller 57 is displaced to a position downstream in the transport direction Y with respect to the transport roller 56 depicted by a solid line in FIG. 6. In this state, a contact point (a nip point) of the transport roller 56 and the driven roller 57 is shifted to the downstream in the transport direction Y with respect to the axial center of the transport roller 56. Therefore, the medium M nipped by the rollers of the transport roller pair 51 is wound round the outer peripheral surface of the transport roller 56 in a range from an intersection of the vertical line which passes through the axial center of the transport roller 56 and orthogonally crosses the transport direction Y and the outer peripheral surface of the transport roller 56 to the contact point (the nip point) of the rollers 56 and 57. Since a contact area of the medium M and the outer peripheral surface of the transport roller 56 increases as the winding amount increases, the medium M becomes not easily slidable with respect to the transport roller 56 as the winding amount becomes larger. Therefore, high accuracy in transport position of the medium M is obtained. However, since the medium M is not easily slidable with respect to the transport roller 56, the skew correction effect is relatively small.

In the reverse transport process in which the transport roller 56 transports the medium M upstream in the transport direction Y, the driven roller 57 is displaced upstream in the transport direction Y, and the winding angle θ becomes smaller than in the forward transport process. Therefore, since the winding amount of the medium M nipped by the rollers of the transport roller pair 51 with respect to the outer peripheral surface of the transport roller 56 decreases relatively and the contact area of the medium M and the outer peripheral surface of the transport roller 56 decreases, the medium M is easily slidable with respect to the transport roller 56. Therefore, in the transport apparatus 18 of the present embodiment, skew of the medium M is corrected more easily in the reverse transport process than in the forward transport process.

Figures 7, 8:
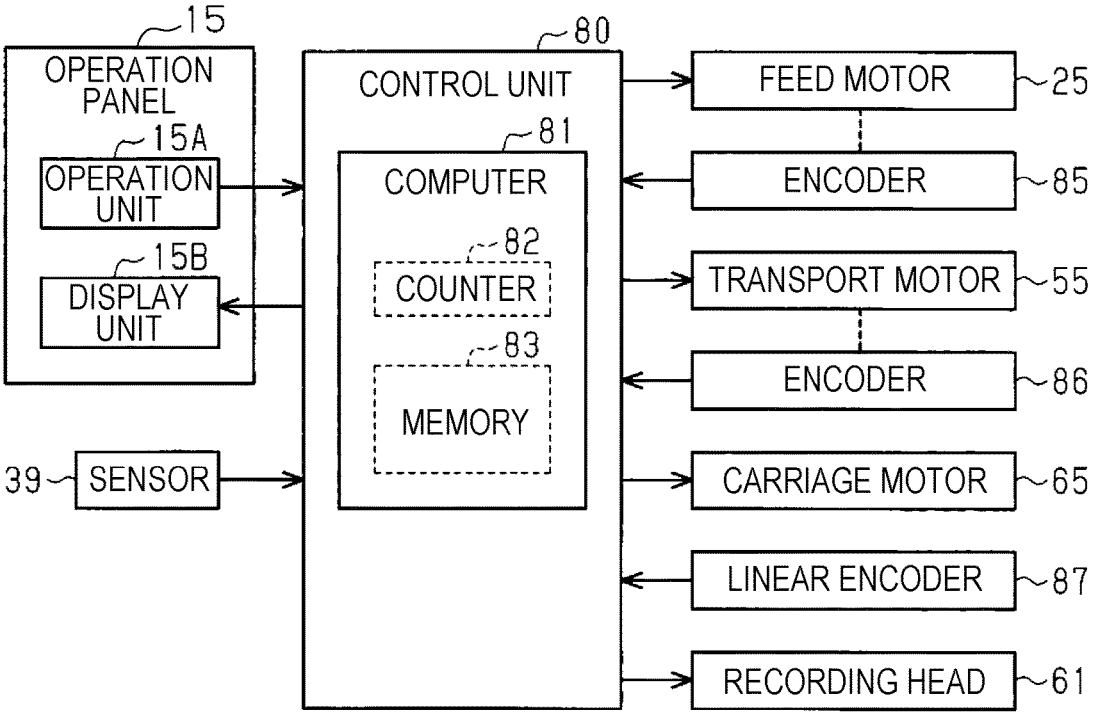
FIG. 7 is a block diagram illustrating an electric constitution of a printer.
FIG. 8 is a schematic diagram illustrating a look-up table.

Next, an electric configuration of the printer 11 will be described with reference to FIG. 7. As illustrated in FIG. 7, the control unit 80 which comprehensively controls the printer 11 includes a computer 81 which is, for example, a large scale integrated circuit (LSI). The computer 81 includes, for example, a central processing unit (CPU) and an Application Specific IC (ASIC) therein. The computer 81 includes a counter 82 and memory 83. The counter 82 is used for counting to measure a transport distance of the medium M and the like. The memory 83 consists of random access memory (RAM) and non-volatile memory, for example. A feed motor 25, a transport motor 55, a carriage motor 65, and the recording head 61 are electrically connected to output terminals of the control unit 80. An operation panel 15, a sensor 39, encoders 85 and 86, and a linear encoder 87 are electrically connected to input terminals of the control unit 80. The operation panel 15 includes an operation unit 15A (for example, a touch operation detection unit) and a display unit 15B.

The control unit 80 controls each of the motors 25, 55, and 65 and the recording head 61 based on print data which the printer 11 received from an external device (not illustrated), and prints an image and the like on the medium M. When the control unit 80 receives a print command issued by the user by operating the operation unit 15A of the operation panel 15, the control unit 80 controls each of the motors 25, 55, and 65 and the recording head 61 based on print data generated in accordance with instructed image data and printing condition information, and prints an image and the like on the medium M.

Figure 9:
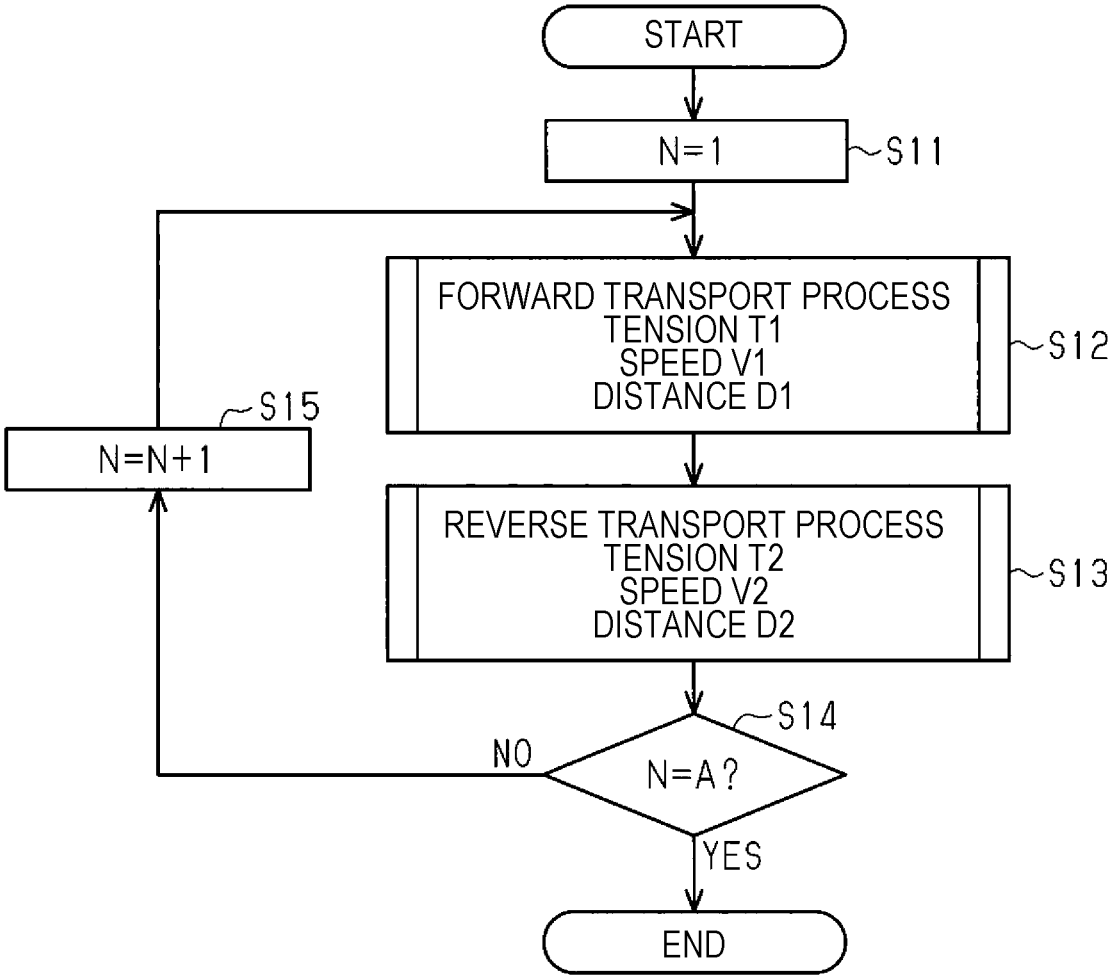
FIG. 9 is a flowchart illustrating a skew correction control routine.

The encoder 85 is, for example, a rotary encoder which is used to detect a rotation amount and a rotational speed of the feed motor 25 and output a detection signal containing the number of pulses proportional to the rotation amount of the feed motor 25. The encoder 86 is, for example, a rotary encoder which is used to detect a rotation amount and a rotational speed of the transport motor 55 or the transport roller 56 which is rotated with power of the transport motor 55, and output a detection signal containing the number of pulses proportional to the rotation amount of the transport motor 55 or the transport roller 56. The linear encoder 87 is used to detect a moving amount and a moving speed of the carriage 63 and output a detection signal containing the number of pulses proportional to the moving amount of the carriage 63.

various programs to be executed by the computer 81 in the control unit 80 when controlling the recording head 61, the feed motor 25, the transport motor 55, and the carriage motor 65, data referred to by the computer 81 for various types of controls, and the like are stored in the memory 83. In the present embodiment, a program for skew correction control illustrated by a flowchart in FIG. 9 is stored in the memory 83 as one of the programs. Reference data RD illustrated in FIG. 8 to be referred to by the computer 81 when the computer 81 executes the program for the skew correction control is stored in the memory 83. The computer 81 executes the skew correction control during a feed process in which the medium M is fed to a print start position by executing the program for the skew correction control stored in the memory 83 while referring to the reference data RD. In the skew correction control, the computer 81 controls driving of the feed motor 25 and the transport motor 55, sequentially performs the forward transport process of transporting the medium M downstream in the transport direction Y and the reverse transport process of transporting the medium M upstream in the transport direction Y, whereby skew of the medium M is corrected.

As illustrated in FIG. 8, in the reference data RD, for example, for each of the medium types, such as regular paper, photographic paper, and matt paper, a tension T1 to be applied to the medium M, a speed V1 at which the medium M is to be transported, and a distance D1 over which the medium M is to be transported in the forward transport process are set individually, and a tension T2, a speed V2, and a distance D2 in the reverse transport process which are similar to T1, V1 and D1, respectively, are set individually. The number of times A of repeating one set of the forward transport process and the reverse transport process is set in the reference data RD. In the example illustrated in FIG. 8, the value of the tension T2 in the reverse transport process is set to be larger than the value of the tension T1 in the forward transport process (T1<T2). The value of the speed V2 in the reverse transport process is set to be larger than the value of the speed V1 in the forward transport process (V1<V2). In the example illustrated in FIG. 8, the value of the distance D1 in the forward transport process and the value of the distance D2 in the reverse transport process are set to be the same (D1=D2). Regarding the number of times A, an individual value is set for each type of the medium, and a plurality of (two or more) number of times of values is set for each type of the medium in this example (A≥2).

The computer 81 controls driving of the feed motor 25 and the transport motor 55 after an end of the skew correction executed during the feed process, and transports the medium M to the print start position. Then, the computer 81 controls the transport of the medium M and the recording by the recording head 61, and the recording head 61 prints an image and the like on the transported medium M. Here, if the printer 11 is a serial printer, an image and the like are recorded on the medium M by repeating a recording operation in which the recording head 61 records on the medium M while moving the carriage 63 in the scanning direction X, and a feeding operation in which the medium M is fed to a subsequent recording position. If the printer 11 is a line printer, an image and the like is printed on the medium M at a high speed with the recording head 61 recording line by line on the medium M which is being transported in the transport direction Y at a constant speed.

Next, an operation of the printer 11 will be described with reference to FIGS. 4 to 9 and other drawings. The user issues a print command by inputting print condition information including information on the type of the medium by operating an input device (not illustrated) of an external device (not illustrated) and instructs printing. Alternatively, the user issues a print command after inputting print condition information including information on the type of the medium by operating the operation unit 15A of the operation panel 15 of the printer 11. In the former case, when a printer driver in the external device receives a print command, the printer driver generates print data based on designated image data and print condition information, and the generated print data is transmitted to the printer 11 by wired or wireless communication. In the latter case, when the computer 81 in the printer 11 receives a print command from the operation unit 15A of the operation panel 15, the computer 81 generates print data based on instructed image data and print condition information.

Then, the computer 81 executes the program stored in the memory 83, and controls a print operation of the printer 11 which controls driving of the recording head 61, the feed motor 25, the transport motor 55, and the carriage motor 65, and prints on the medium M. In the following description, it is supposed that the user has selected the roll body RT (for example, the rolled sheet) and instructed printing. At this time, the print condition information which the computer 81 acquires information that a printing target is the roll body RT and information on the type of the medium.

First, the computer 81 causes the roll body RT to rotate in the forward direction by driving the feed motor 25 to rotate in the forward direction so as to drive the feed axis 24 to rotate, and unrolls the elongated medium M from the roll body RT, whereby feeding is started. In this feed process, the computer 81 executes the program for the skew correction control illustrated in FIG. 9. That is, the computer 81 performs skew correction of correcting skew of the medium M in the feed process in which the medium M is fed to the print start position. In particular, when the feeding of the medium M is started and the computer 81 detects that the leading end of the medium M has reached a predetermined position during feeding, the computer 81 executes the program illustrated in the flowchart of FIG. 9. Detection that the leading end of the medium M has reached a predetermined position is performed based on a count value which is a driving amount of the feed motor 25 counted by the counter 82 after the sensor 39 detects the leading end of the medium M (for example, the number of steps). The computer 81 starts the skew correction control when, for example, the leading end of the medium M reaches a predetermined position in which the leading end is nipped by the rollers of the transport roller pair 51 by a predetermined amount.

Hereinafter, the skew correction control to be executed by the computer 81 will be described with reference to FIG. 9. First, in step S11, the computer 81 sets an initial value of the number of times N (N=1).

In the next step S12, the computer 81 performs the forward transport process. That is, the computer 81 performs the forward transport process in which both the feed motor 25 and the transport motor 55 are driven to rotate in the forward direction, and the transport roller 56 is rotated in the following direction as illustrated by an arrow depicted by a solid line in FIG. 5 while the medium M being nipped by the rollers of the transport roller pair 51, whereby the medium M is transported downstream in the transport direction Y by the distance D1. The forward transport of the medium M in this forward transport process is performed on the condition of the tension T1, the speed V1, and the distance D1 in the forward transport process in accordance with the type of the medium at that time obtained with reference to the reference data RD. Here, the computer 81 controls the tension T1 based on a difference of the driving speed in the forward rotation direction between the feed motor 25 and the transport motor 55.

That is, the computer 81 drives both the feed motor 25 and the transport motor 55 to rotate in the forward direction, and these motors 25 and 55 are driven to rotate in the forward direction so that the transport speed of the medium M by the transport roller 56 becomes higher than a feed speed at which the medium M is unrolled from the roll body RT to obtain a speed difference in accordance with the tension T1. Thus, since the computer 81 controls a difference of the driving speed between the feed motor 25 and the transport motor 55, a back tension based on a difference between the feed speed and the transport speed is applied to the medium M which is being transported in the forward direction. Skew of the medium M is corrected when the medium M is transported in the forward direction by the distance D1 with the tension T1 at the speed V1 with the back tension being applied to the medium M. Alternatively, load to be applied to the transport motor 55 which draws the medium M on the downstream side between the two motors 25 and 55 may be detected, and the speed of the motors 25 and 55 may be controlled so that the load becomes a value in accordance with the tension T1. In this case, since the forward transport in which the medium M is transported downstream in the transport direction Y is performed in step S12, the speed of the transport motor 55 on the drawing side is controlled so that the load of the transport motor 55 becomes a value in accordance with the tension T1. Therefore, a back tension based on a difference between the feed speed and the transport speed is applied to the medium M which is being transported in the forward direction. Skew of the medium M is corrected when the medium M is transported in the forward direction by the distance D1 with the tension T1 at the speed V1 with the back tension being applied to the medium M. In the forward transport process, the speed is controlled so that the transport speed of the medium M determined by the driving speed of the feed motor 25 of which transport speed is lower than the transport speed of the transport motor 55 becomes the speed V1. When the transport distance of the medium M from the forward transport start point reaches the distance D1 based on the count value obtained by the counter 82 by calculating a pulse edge of a detection signal from the encoder 86, the computer 81 stops driving of the motors 25 and 55. Therefore, in the forward transport process, the medium M is transported from a control start position in which the medium M is nipped by the rollers of the transport roller pair 51 by a predetermined amount to the downstream in the transport direction Y with the tension T1, at the speed V1, by the distance D1.

However, as illustrated in FIG. 7, in the forward transport process, the axial center of the driven roller 57 is located downstream of the axial center of the transport roller 56 in the transport direction Y, and the winding angle θ is relatively large. Therefore, the winding amount of the medium M round the outer peripheral surface of the transport roller 56 is relatively large, and sliding resistance between the medium M and the transport roller 56 is relatively large. Therefore, the medium M and the transport roller 56 are not easily slidable relatively, and a skew correction effect of the medium M is relatively small.

In the next step S13, the computer 81 performs the reverse transport process. That is, the computer 81 drives both the feed motor 25 and the transport motor 55 in the reverse direction and causes the transport roller 56 to rotate in the reverse direction illustrated by an arrow as depicted by the two-dot chain line in the FIG. 5 while the medium M being nipped by the rollers of the transport roller pair 51. Thus, the medium M is transported upstream in the transport direction Y by the distance D2. The reverse transport of the medium M in this reverse transport process is performed on the condition of the tension T2 (>T1), the speed V2 (>V1), and the distance D2 (=D1) in the reverse transport process in accordance with the type of the medium obtained with reference to the reference data RD. Here, the computer 81 controls the tension T2 based on a difference in the driving speed in the reverse rotation direction between the feed motor 25 and the transport motor 55.

That is, the computer 81 drives both the feed motor 25 and the transport motor 55 to rotate in the reverse direction, and these motors 25 and 55 are driven to rotate in the reverse direction so that the feeding speed of the medium M unrolled from the roll body RT becomes higher than the transport speed of the medium M by the transport roller 56 to obtain a speed difference in accordance with the tension T2. Thus, since the computer 81 controls a difference of the driving speed between the feed motor 25 and the transport motor 55, a back tension based on a difference between a rewinding speed and the reverse transport speed is applied to the medium M which is being transported in the reverse direction. Skew of the medium M is corrected when the medium M is transported in the reverse direction by the distance D2 with the tension T2 at the speed V2 with the back tension being applied to the medium M. Alternatively, load to be applied to the feed motor 25 which draws the medium M on the downstream side between the two motors 25 and 55 may be detected, and the speed of the motors 25 and 55 may be controlled so that the load becomes a value in accordance with the tension T2. In this case, since the reverse transport in which the medium M is transported upstream in the transport direction Y is performed in step S13, the speed of the feed motor 25 on the drawing side is controlled so that the load of the feed motor 25 becomes a value in accordance with the tension T2. Therefore, a back tension based on a difference between the rewinding speed and the reverse transport speed is applied to the medium M which is being transported in the reverse direction. Skew of the medium M is corrected when the medium M is transported in the reverse direction by the distance D2 with the tension T2 at the speed V2 with the back tension being applied to the medium M. In the reverse transport process, the speed is controlled so that the transport speed of the medium M determined by the driving speed of the transport motor 55 of which transport speed is lower than the transport speed of the transport motor 52 becomes the speed V2. When the transport distance of the medium M from the reverse transport start point reaches the distance D2 based on the count value obtained by the counter 82 by calculating a pulse edge of a detection signal from the encoder 86, the computer 81 stops driving of the motors 25 and 55. Therefore, in the reverse transport process, the medium M is transported from a position in which the forward transport process is completed to the upstream in the transport direction Y with the tension T2, at the speed V2, by the distance D2 with the medium M being nipped by the rollers of the transport roller pair 51.

As illustrated in FIG. 6, in the reverse transport process, the position of the axial center of the driven roller 57 and the position of the axial center of the transport roller 56 illustrated by a two-dot chain line in FIG. 6 substantially coincide with each other in the transport direction Y, and the winding angle θ is relatively small (for example, θ≈0°). Therefore, the winding amount of the medium M round the outer peripheral surface of the transport roller 56 is relatively small, and sliding resistance between the medium M and the transport roller 56 is relatively small. Therefore, the medium M and the transport roller 56 are relatively slidable with each other, and a relatively high skew correction effect is obtained. Determination as to whether the medium M has reached each of the distances D1 and D2 in the forward transport process and the reverse transport process may be made based on a detection signal of the encoder 85 of the first feed unit 21, or by switching the encoders 85 and 86 used to measure the distance in accordance with the forward transport process and the reverse transport process.

In the next step S14, the computer 81 determines whether the number of times N has reached the set number of times A (N=A?). Since this is the first process (N=1), N=A is not completed. Therefore, after incrementing the value of the number of times N in step S15, the process returns to step S12.

Hereinafter, similarly, the processes of steps S12 to S15 are repeated until the number of times N reaches the set number of times A in step S14 and N=A. The forward transport process (S12) and the reverse transport process (S13) are repeated until the number of times N reaches the set number A (S14: YES), and then the skew correction control of the routine is completed.

When the skew correction is completed, the control unit 80 (the computer 81) drives the feed motor 25 and the transport motor 55 to rotate in the forward direction and transports the medium M to the print start position downstream in the transport direction Y. When the medium M is transported to the print start position, the control unit 80 drives the carriage motor 65 and moves the carriage 63 in the scanning direction X. Recording on the medium M by the recording head 61 is performed while the carriage 63 is moved. If the printer 11 is a serial printer, an image and the like are printed on the medium M by repeating the transport operation of the medium M and the recording operation for one line by the recording head 61 during the movement of the carriage 63. If the printer 11 is a line printer, an image and the like are printed on the medium M with the recording head 61 recording line by line on the medium M transported at a constant speed. Since an image and the like are printed on the medium M of which skew is corrected effectively, the image and the like can be printed on the medium M with substantially no misalignment, such as tilt.

According to the above embodiment, the following effects can be obtained. (1) The transport apparatus 18 includes the feed unit 20 as an example of the supply unit which supplies the medium M in the transport direction Y, and the transport unit 50 which transports the medium M supplied from the feed unit 20. The transport unit 50 includes the transport roller 56 which sends the medium M, and the driven roller 57 which nips the medium M between the transport roller 56 and the driven roller 57. The driven roller 57 is movable in the transport direction Y relative to the transport roller 56. Therefore, slidability between the medium M and the transport roller 56 can be adjusted by changing a relative position of the driven roller 57 with respect to the transport roller 56 in the transport direction Y. Especially in this example, sliding resistance between the rollers 56 and 57 and the medium M is adjusted by changing the winding angle θ by a relative movement of the driven roller 57 with respect to the transport roller 56 in the transport direction Y. In the reverse transport process in which the medium M is transported upstream in the transport direction Y, sliding resistance between the medium M and the transport roller 56 is adjusted smaller by changing the winding angle θ smaller than in the forward transport process. Therefore, skew of the medium M can be corrected effectively.

(2) The driven roller 57 is provided to be movable in the transport direction Y. The transport apparatus 18 further includes the tension spring 78 as an example of an urging member which urges the driven roller 57 in the transport direction Y. Therefore, when the transport roller 56 is rotated in a rotational direction in which the medium M can be transported in the urging direction of the tension spring 78, the driven roller 57 can be moved in the transport direction Y positively with the urging force of the tension spring 78. Therefore, compared with a configuration in which no tension spring 78 is provided, the driven roller 57 can be moved with a more positive moving amount in the transport direction Y. For example, an occurrence frequency of a failure in skew correction resulting from a failure in movement that the driven roller 57 does not move in the transport direction Y as desired can be reduced. Therefore, a frequency of performance of appropriate skew correction can be increased.

(3) When the transport roller 56 sends the medium M downstream in the transport direction Y, the axial center of the driven roller 57 is located downstream of the axial center of the transport roller 56 in the transport direction Y. Therefore, when the transport roller 56 sends the medium M downstream in the transport direction Y, the contact area of the medium M and the transport roller 56 can be increased relatively. That is, the winding angle θ can be increased so that the axial center of the driven roller 57 is located downstream of the axial center of the transport roller 56 in the transport direction Y, and the contact area of the medium M and the transport roller 56 can be increased relatively. Therefore, accuracy in transport position of the medium M by the transport roller pair 51 can be increased. Therefore, accuracy in print position when the recording unit 60 prints on the medium M can be increased and, thereby, a printed matter of high quality can be obtained.

(4) The amount of misalignment in the transport direction of the axial center of the driven roller 57 and the axial center of the transport roller 56 when the transport roller 56 sends the medium M upstream in the transport direction Y (the reverse transport process) is smaller than the amount of misalignment when the transport roller 56 sends the medium M downstream in the transport direction Y (the forward transport process). Therefore, sliding resistance between the medium M and the transport roller 56 in the reverse transport process can be made relatively smaller than in the forward transport process. Therefore, the medium M becomes relatively slidable with respect to the transport roller 56, and skew of the medium M can be corrected effectively. Especially in the present embodiment, in the reverse transport process, the axial center of the driven roller 57 in the transport direction Y is disposed in the substantially same position (θ≈0°) as the axial center of the transport roller 56. Therefore, since sliding resistance between the medium M and the transport roller 56 can be made especially smaller and slidability of the medium M with respect to the transport roller 56 can be further increased, the skew correction effect of the medium M can be further improved. When the transport roller 56 sends the medium M downstream in the transport direction Y, the medium M does not easily slide relative to the transport roller 56. Therefore, after the skew correction is completed, accuracy in transport position when sending the medium M downstream in the transport direction Y can be increased. Therefore, since the recording unit 60 can be printed with high accuracy in print position on the medium M, a printed matter of high quality can be obtained.

(5) The printer 11 includes the transport roller 56, the transport apparatus 18 which includes the driven roller 57 movable in the transport direction Y relative to the transport roller 56, and the recording unit 60 which records on the medium M supplied by the transport apparatus 18. Therefore, the recording unit 60 can record on the medium M supplied by the transport apparatus 18 in the state in which skew has been effectively corrected. Therefore, a printed matter of high quality in which inclination, misalignment and the like of the medium M are reduced can be provided.

(6) The transport method for transporting the medium M includes the forward transport process (S12) and the reverse transport process (S13), and repeats the forward transport process and the reverse transport process a plurality of times. In the forward transport process (S12), the medium M is transported downstream in the transport direction Y in the state in which the axial center of the driven roller 57 in the transport direction Y is located downstream of the axial center of the transport roller 56 in the transport direction Y. In the reverse transport process (S13), the medium M is transported upstream in the transport direction Y in the state in which the amount of misalignment of the axial center of the driven roller 57 and the axial center of the transport roller 56 in the transport direction Y is made smaller than the amount of misalignment in the forward transport process. Therefore, in the reverse transport process, sliding resistance between the medium M and the transport roller 56 can be made smaller than in the forward transport process, and the medium M can be made easy to slide with respect to the transport roller 56. Since the forward transport process and the reverse transport process are repeated a plurality of times, skew of the medium M can be corrected effectively.

(7) In the reverse transport process in which sliding resistance between the medium M and the transport roller 56 can be made relatively small, at least one of the tension T to be applied to the medium M and the speed V at which the medium M is to be transported is made larger than in the forward transport process. Therefore, compared with a case in which the value of the tension T and the value of the speed V are made to be the same in the forward transport process and in the reverse transport process, for example, the skew correction effect can be more effectively improved. Both the tension T and the speed V are especially made larger more in the reverse transport process than in the forward transport process. Therefore, the skew correction effect can be improved much more effectively.

The above embodiment may be changed as the following alternative embodiments. The above embodiment and the following alternative embodiments may be combined arbitrarily. The driven roller 57 may be made movable in the transport direction Y using a cam mechanism. For example, the cam mechanism includes a cam member which can press the driven roller 57 and move the driven roller 57 in the transport direction Y. The cam member is, for example, a rotating cam, and when the transport roller 56 (the driving roller) is driven to rotate in a forward direction so as to move the medium M downstream in the transport direction Y, the rotation cam is rotated in the forward direction in a predetermined rotation range. A cam follower to engage with a cam portion of the rotating cam by the rotation of the rotating cam in the forward direction is displaced downstream in the transport direction Y, and the driven roller 57 is moved downstream in the transport direction Y following the displacement. Therefore, the driven roller 57 is displaced to a relative position (θ=θ1 (>θ2)) in which the winding angle θ becomes larger relative to the transport roller 56. When the transport roller 56 is rotated in the reverse direction in which the medium M is moved upstream in the transport direction Y, the rotation cam is moved in the reverse direction in a predetermined rotation range. A cam follower to engage with a cam portion of the rotating cam by the rotation of the rotating cam in the reverse direction is displaced upstream in the transport direction Y, and the driven roller 57 is moved upstream in the transport direction Y following the displacement. Therefore, the driven roller 57 is displaced to a relative position (θ=θ2 (≈0°)) in which the winding angle θ becomes smaller relative to the transport roller 56. Therefore, in the process in which the medium M is moved upstream in the transport direction Y, sliding resistance between the medium M and the transport roller pair 51 which nips the medium M becomes relatively small, and skew of the medium M becomes easy to be corrected. It is especially desirable to make the reverse transport speed in the reverse transport process be higher than the forward transport speed in the forward transport process. Further, it is desirable to make tension of the medium M in the reverse transport process be larger than the tension of the medium M in the forward transport process. It is desirable to repeat the forward transport process and the reverse transport process a plurality of times. It is desirable to provide an urging member which urges the driven roller 57 in one direction (for example, upstream) in the transport direction Y. The can may be a plane cam or a solid cam.

Although the swing member 75 is provided to be movable in the transport direction Y with respect to the frame 17 in the above embodiment, the driven roller 57 may be provided to be movable in the transport direction Y with respect to the swing member 75. For example, the rotation axis of the driven roller 57 may be inserted in an elongated hole formed in the swing member 75, and the driven roller 57 may be moved in the transport direction Y with respect to the swing member 75. That is, the driven roller 57 may desirably be provided to be movable in the moving direction which has the transport direction Y as a moving direction component with respect to the transport roller 56.

In the embodiment, it is not necessary to keep the nip state in which the medium M is nipped by the transport roller 56 and the driven roller 57 during the skew correction. For example, if a medium which would not curl or the like or a medium of which portion downstream of the transport roller pair 51 in the transport direction Y has not been printed is employed, the nipped state may be released temporarily. In this case, a discharge operation in which the transport roller 56 is driven to rotate in the reverse direction with the feed unit 20 being stopped, for example, to discharge the medium M out of the transport roller pair 51 to the upstream in the transport direction Y, and skew is corrected by making the leading end of the medium M hit the transport roller pair 51 by using elasticity of the medium M bent by the discharge (second skew correction) may be used at the same time. With this configuration, skew of the medium M can be corrected much more effectively.

A driving source dedicated for the movement of the driven roller 57 may be provided, and the driven roller 57 may be moved in the transport direction Y by using the driving force of the driving source. For example, in the skew correction, in both the forward transport process and the reverse transport process, the control unit 80 drives the driving source in the reverse direction, and disposes the driven roller 57 in a position in which the winding angle becomes $\theta=\theta 2$ ($\approx 0$). During head-detection in which the medium M is transported to the print start position after the skew correction is completed, the control unit 80 may drive the driving source in the forward direction, and disposes the driven roller 57 in a position in which the winding angle $\theta=\theta 1$ ($>\theta 2$). The driving source is an electric motor, a solenoid, a cylinder, and the like, for example. With this configuration, since the medium M and the transport roller 56 can be made easy to slide in both the forward transport process and the reverse transport process, skew can be corrected much more effectively. As in the above embodiment, in the forward transport process, the control unit 80 may drive the driving source in the forward direction, and may dispose the driven roller 57 in the position in which the winding angle is set to $\theta=\theta 1$ ($>\theta 2$).

Although the distances D1 and D2 over which the medium M is to be transported in the forward transport process and in the reverse transport process are the same (D1=D2) in the above embodiment, these distances may be different from each other (D1≠D2). For example, the distance D2 of the reverse transport process may be made shorter than the distance D1 of the forward transport process (D1>D2) or the distance D2 of the reverse transport process may be made longer than the distance D1 of the forward transport process (D1<D2). If the forward transport process and the reverse transport process are repeated a plurality of times, the distance D may be increased gradually or may be decreased gradually as the number of times increases. Short distances D1 and D2, and long distances D1 and D2 may be repeated alternately. However, regarding a medium M of a rolled form which may curl and the like (for example, a rolled sheet), in any of the above cases, it is desirable to set the values of the distances D1 and D2 in a range in which the nipped state of the medium M by the transport roller pair 51 can be kept.

If the transport roller 56 and the driven roller 57 are movable relative to each other in the transport direction Y, the transport roller 56 may further be provided to be movable in the transport direction Y instead of, or in addition to the driven roller 57. Also with this configuration, since the transport roller 56 and the driven roller 57 move relative to each other in the transport direction Y during the reverse transport and the winding angle θ can be reduced, slidability between the medium M and the transport roller 56 can be adjusted between in the forward transporting and in the reverse transporting. Therefore, skew of the medium M can be corrected effectively. For example, the cam mechanism which includes the rotating cam that cooperates with the rotation of the transport roller 56 is provided, the cam follower to engage with the cam portion of the rotating cam when the rotating cam is rotated in the forward direction during the forward transport is displaced upstream in the transport direction Y, and the transport roller 56 is moved to a position upstream in the transport direction Y ($\theta=\theta 1$ ($>\theta 2$)) in which the winding angle θ is made relatively large. The cam follower to engage with the cam portion of the rotating cam when the rotating cam is rotated in the reverse direction during the reverse transport is displaced downstream in the transport direction Y, and the transport roller 56 is moved to a position downstream in the transport direction Y ($\theta=\theta 2$ ($\approx 0°$)) in which the winding angle θ is made relatively small. Since the driving source is provided and the transport roller 56 is moved in the transport direction Y by the driving force of the driving source, the driven roller 57 is movable in the transport direction Y relative to the transport roller 56. An urging member which urges the transport roller 56 downstream in the transport direction Y may be provided.

The medium M is not limited to an elongated medium wound round in a rolled form, such as a rolled sheet, and may be, for example, a cut sheet. Even if a cut sheet is employed, since the rollers 56 and 57 and the medium M become easier to slide in the reverse transport process than in the forward transport process, skew can be corrected effectively. In this case, in addition to the skew correction in which the medium M is made to reciprocate in a nipped state in the transport direction Y (the first skew correction), discharging of the medium M (the second skew correction) may be employed at the same time.

The configuration that the axial center of the driven roller 57 and the axial center of the transport roller 56 are in substantially the same position ($\theta\approx 0°$ in which the amount of misalignment is substantially 0) in the transport direction Y in the reverse transport process is not restrictive. The amount of misalignment of the axial center of the driven roller 57 and the axial center of the transport roller 56 in the transport direction Y may desirably be smaller in the reverse transport process than in the forward transport process.

Although the forward transport process and the reverse transport process are repeated a plurality of times, these processes may be performed only once. Although both the tension T to be applied to the medium and the speed V at which the medium M is to be transported are made to be larger in the reverse transport process than in the forward transport process in the above embodiment, only one of the tension T and the speed V may be made to be larger in the reverse transport process than in the forward transport process.

The tension T1 and the tension T2 to be applied to the medium in the forward transport process and in the reverse transport process may be the same (T1=T2), or on the contrary to the above embodiment, the tension T2 of the reverse transport process may be made smaller than the tension T1 of the forward transport process (T1>T2).

The speed V1 and the speed V2 at which the medium M is to be transported in the forward transport process and in the reverse transport process may be the same (V1=V2), or on the contrary to the above embodiment, the speed V2 of the reverse transport process may be made smaller than the speed V1 of the forward transport process (V1>V2).

In the above embodiment, the swing member 75 is urged in two different directions by the tension spring 76 (the first urging member) and the tension spring 78 (the second urging member as the urging member). However, urging in the urging direction by the first urging member and urging in the transport direction Y by the second urging member may be performed by a single urging member.

In the embodiment, the third feed unit 23 function also as a supply unit to which the transport roller pair 51 supplies a medium, and a part of the transport unit which transports the medium M with the discharge roller pairs 52 to 54. However, a feed roller (for example, a roller pair) may be provided as a supply unit, and the transport roller pair 51 may not function as a supply unit.

One of both of the second feed unit 22 and the third feed unit 23 may be excluded or the first feed unit 21 is excluded and one or both of the second feed unit 22 and the third feed unit 23 may be used as the supply unit. Further, the feed unit may employ a cassette feed system which includes a cassette which can accommodate a plurality of media (for example, cut sheets), and a pickup roller which feeds the medium M among a plurality of media M in the cassette on at a time from the topmost one. In this case, the supply unit may include only the feed unit of the cassette feed system, or at least one of the first to the third feed units 21 to 23 in addition to the supply unit of the cassette feed system.

In the printer 11 of the embodiment, a mounting portion with which a liquid receptacle 69 is mounted at a position different from the carriage 63 may be provided. For example, the mounting portion is fixed to an inside of the housing 12 (for example, a body frame) or a side surface of an outside of the housing 12, and supplies a liquid (for example, ink) to the carriage 63 through an unillustrated ink tube from a liquid containing portion mounted on the mounting portion.

In the above embodiment, the medium M may be any of paper, film, cloth, resin sheet, laminated sheet, and metallic foil. The recording apparatus is not limited to an ink jet printer, but may be an electrophotographic printer, a dot impact printer, a thermal transfer printer, and a printing apparatus. The recording apparatus may be any of a serial printer, a lateral printer, a line printer, and a page printer. The recording apparatus may desirably at least have a recording function (a printing function) to record on the medium, and may also be a multifunction apparatus having functions other than the recording function. Other functions may include a copy function, a scanning function, and a facsimile function.

This application claims priority under 35 U.S.C. § 119 to Japanese Patent Application No. 2017-065585, filed Mar. 29, 2017. The entire disclosure of Japanese Patent Application No. 2017-065585 is hereby incorporated herein by reference.

What is claimed is:

1. A transport apparatus, comprising:

a supply portion that supplies a medium in a transport direction; and a transport unit that transports the medium supplied from the supply portion, wherein the transport unit includes a transport roller that sends the medium, and a driven roller that nips the medium between the transport roller and the driven roller, and the driven roller is movable in the transport direction relative to the transport roller, wherein the transport unit is configured to:

forward-transport the medium downstream in the transport direction in a state in which an axial center of the driven roller in the transport direction is located downstream of an axial center of the transport roller in the transport direction; and reverse-transport the medium upstream in the transport direction in the state in which an amount of misalignment of the axial center of the driven roller and an axial center of the transport roller in the transport direction is made smaller than the amount of misalignment in the forward transporting.

2. The transport apparatus according to claim 1, wherein the driven roller is provided to be movable in the transport direction, and the transport apparatus further comprises an urging member that urges the driven roller toward the transport direction.

3. The transport apparatus according to claim 1, wherein, when the transport roller sends the medium downstream in the transport direction, an axial center of the driven roller is located downstream of an axial center of the transport roller in the transport direction.

4. The transport apparatus according to claim 1, wherein an amount of misalignment in the transport direction of an axial center of the driven roller and an axial center of the transport roller when the transport roller sends the medium upstream in the transport direction is smaller than the amount of misalignment when the transport roller sends the medium downstream in the transport direction.

5. A recording apparatus that records on a medium, comprising:

a transport apparatus according to claim 1; and a recording unit that records on the medium supplied by the transport apparatus.

6. A recording apparatus that records on a medium, comprising:

a transport apparatus according to claim 2; and a recording unit that records on the medium supplied by the transport apparatus.

7. A recording apparatus that records on a medium, comprising:

a transport apparatus according to claim 3; and a recording unit that records on the medium supplied by the transport apparatus.

8. A recording apparatus that records on a medium, comprising:

a transport apparatus according to claim 4; and a recording unit that records on the medium supplied by the transport apparatus.

9. A transport method in a transport apparatus provided with a transport unit that includes a supply unit that supplies a medium in a transport direction, a transport roller that sends the medium supplied from the supply unit, and a driven roller that nips the medium between the transport roller and the driven roller, the method comprising:

forward-transporting the medium downstream in the transport direction in a state in which an axial center of the driven roller in the transport direction is located downstream of an axial center of the transport roller in the transport direction; and reverse-transporting the medium upstream in the transport direction in the state in which an amount of misalignment of the axial center of the driven roller and an axial center of the transport roller in the transport direction is made smaller than the amount of misalignment in the forward transporting, wherein the forward-transporting and the reverse-transporting are repeated a plurality of times.

10. The transport method according to claim 9, wherein at least one of a tension to be applied to the medium and a speed at which the medium is to be transported is made larger in the reverse-transporting than in the forward-transporting.

* * * * *